US007855636B2

(12) United States Patent
Martin et al.

(10) Patent No.: US 7,855,636 B2
(45) Date of Patent: Dec. 21, 2010

(54) METHOD FOR DYNAMICALLY ADJUSTING THE SENSITIVITY OF A SENSOR IN A SECURITY SYSTEM

(75) Inventors: Christopher D. Martin, Plainview, NY (US); Thomas S. Babich, Glen Cove, NY (US)

(73) Assignee: Honeywell International Inc., Morristown, NJ (US)

( * ) Notice: Subject to any disclaimer, the term of this patent is extended or adjusted under 35 U.S.C. 154(b) by 420 days.

(21) Appl. No.: 11/857,598

(22) Filed: Sep. 19, 2007

(65) Prior Publication Data

US 2009/0072961 A1 Mar. 19, 2009

(51) Int. Cl.
*G08B 19/00* (2006.01)

(52) U.S. Cl. ..... 340/522; 340/539.22; 340/511

(58) Field of Classification Search ..... 340/522, 340/511, 521, 523, 525, 524, 526–527, 539.22, 340/539.19, 539.17, 539.26
See application file for complete search history.

(56) References Cited

U.S. PATENT DOCUMENTS 4,604,871 A * 8/1986 Chiu et al. ..... 62/136
5,327,349 A * 7/1994 Hoste ..... 700/110
5,416,725 A * 5/1995 Pacheco et al. ..... 702/176
5,552,763 A * 9/1996 Kirby ..... 340/506
5,652,567 A * 7/1997 Traxler ..... 340/552
6,035,139 A * 3/2000 Nakamura ..... 396/121
6,100,792 A * 8/2000 Ogino et al. ..... 340/426.25
6,353,385 B1 * 3/2002 Molini et al. ..... 340/506
7,409,045 B2 * 8/2008 Naidoo et al. ..... 379/37
2006/0012472 A1 * 1/2006 Eskildsen ..... 340/511

* cited by examiner

*Primary Examiner*—Daniel Previl
(74) *Attorney, Agent, or Firm*—Husch Blackwell Welsh & Katz

(57) ABSTRACT

A method for dynamically changing a control panel response to a transmission from one or more multi-output sensors. The transmission includes a state of a plurality of sensitivity levels for each multi-output sensor indicating multiple outputs. The method comprising the steps of receiving a transmission from the multi-output sensor, determining a source of the transmission, determining a state of each of the sensitivity levels determining if at least one selection criterion is set for selecting one of the plurality of sensitivity levels included in the transmission based upon the determined source. One of the sensitivity levels is selected based upon the determination and an alarm is generated based upon said selected sensitivity level. If more than one selection criterion is set, a priority for the selection criterion is determined.

28 Claims, 5 Drawing Sheets

METHOD FOR DYNAMICALLY ADJUSTING THE SENSITIVITY OF A SENSOR IN A SECURITY SYSTEM

BACKGROUND OF THE INVENTION

1. Field of the Invention

This invention relates to security systems, multi-output sensors and adjusting the sensitivity of the multi-output sensors. More particularly, this invention relates to a method for dynamically responding to only one output of a multi-output sensor based upon certain preset criterion.

2. Background

A security system includes any life, safety, and property protection system. A security system comprises a local security system located in a commercial or residential premises in communication with a remote monitoring station. The local security system typically includes a central control panel that communicates with a number of sensors via a wired or wireless path. The control panel has the ability to notify local emergency services and/or a remote monitoring station of an alarm condition via a telephone dialer. The local security system also includes a local alarm generating section responsive to the sensors. The sensors are deployed throughout the commercial or residential premises. The sensors are separated into zones. Typically, at least one sensor is deployed in each zone.

A sensor is used to detect many different types of events, e.g., glass break, motion, temperature and shock. A single sensor has several different sensitivity levels. The types of sensors include a single output sensor and a multi-output sensor. The sensitivity of a single output sensor can be manually adjusted using switches during installation. A multi-output sensor includes a multi-loop transmitter to transmit the multiple outputs. An output of the multi-loop transmitter corresponds to a different sensitivity level. One of the outputs corresponds to a malfunction of the sensor.

For example, a multi-output sensor may have low, medium, and high sensitivity outputs to accommodate different room environments. Such low, medium, and high sensitivity outputs may, for example, correspond, respectively, to an intruder taking three steps, two steps, or one step in a protected space. The control panel can only respond to one output from the multi-output sensor, i.e., one loop from the multi-loop transmitter. The sensitivity of the sensor can be set during the installation of the security system.

U.S. patent application Ser. No. 10/893,037(the '037 Application") entitled "Method for Remotely Changing the Sensitivity of a Wireless Sensor" filed on Jul. 15, 2004, assigned to Honeywell International, Inc. describes a method for remotely programming an apparatus to respond to only one loop received from the multi-loop transmitter even if multiple loops are received. The '037 Application describes a method to program an apparatus remotely to operatively connect one of a first or second output.

The apparatus receives all of the multi-loop signals from the multi-loop transmitter and is programmed to only respond to one. The loop number of the sensor is assigned a different sensitivity level. During installation, the installer chooses the loop number associated with the desired sensitivity setting. At a later time, the installer can change the sensitivity of the sensor by remotely changing the loop number programmed into the apparatus.

However, the apparatus will always respond to the same loop number and have the same sensitivity, unless the installer reprograms the apparatus. The apparatus described in the '037 Application cannot respond to a different loop number depending on conditions within the protected premises. In other words, there is a need to be able to change the sensitivity of the sensor in a dynamic fashion to account for the environment conditions and status of the security system.

BRIEF SUMMARY OF THE INVENTION

The present invention includes a security system with a sensor having the ability to respond and generate an alarm signal based upon different loop outputs from the multi-output sensor depending on at least one selection criterion. The selection criterion can be preset and programmed into a control panel located in the protected premises. Additionally, the selection criterion can be remotely modified, at a later time, using a downloader.

Accordingly, disclosed is a method for dynamically changing a control panel response to a transmission from a plurality of multi-output sensors. The transmission includes a state of each sensitivity level of the plurality of multi-output sensors indicating multiple outputs. The control panel is programmed with at least one selection criterion for selecting one of the plurality of sensitivity levels from the transmission from each multi-output sensor. The method comprises the steps of receiving a transmission from one of the plurality of multi-output sensors, determining a source of the transmission, determining a state of each sensitivity level, determining if at least one selection criterion is set based upon the determined source, selecting one of the plurality of sensitivity levels based upon the determination, and responding to the selected sensitivity level.

The multi-output sensor includes a multi-loop transmitter. Each loop corresponds to one output of the multi-output sensor. Each loop is assigned a loop number. The loop number is associated with one output. At least two loop numbers are assigned to sensitivity levels. Changing the loop number in which a control panel responds effectively changes the sensitivity of the multi-output sensor.

A selection criterion can be a status of the security system, such as arm-away, arm-stay or disarmed. Additionally, the selection criterion can be a state of the security system such as an alarm state or the state of other sensors, i.e. alarm condition detected. For example, a maximum sensitivity can be selected if the security system is in an active alarm. Additionally, the selection criterion can be a specific zone where the multi-output sensor is located. Additionally, the selection criterion can be a time period, e.g. a specific time of the day. Additionally, the selection criterion can be an environmental condition such as weather, inside temperature or sound level. The selection criterion can also be a state of the HVAC.

The selection criterion can be programmed during installation or from a remote location.

If there is more than one selection criterion associated with a specific multi-output sensor, a selection priority is determined and the selection criterion with the highest priority is examined first with respect to each sensitivity level.

Also disclosed is a method for configuring a control panel of a security system to dynamically change a response to an output of a multi-output sensor. The method comprises the steps of assigning a loop number to each output of the multi-output sensor, programming an unique identifier associated with the multi-output sensor into the control panel, determining at least one selection criterion and assigning a loop number to each sub-option for the at least one selection criterion. The control panel only responds to a loop number if the at least one sub-option occurs at a time when the loop number indicates a detection of an event. The method also includes a step of determining each sub-option for each of the at least one selection criterion. At least two loop numbers are associated with sensitivity levels If more than one selection criterion is programmed, a priority for the programmed selection criteria are determined. The priority can either be customized or a default priority can be used.

Also disclosed is a method for dynamically changing a control panel response to a transmission from a multi-output sensor. The transmission includes a state of a plurality of sensitivity levels for the multi-output sensor indicating multiple outputs of the multi-output sensor. The control panel is programmed with at least one selection criterion for selecting one of the plurality of sensitivity levels from the transmission, The method comprising the steps of receiving a transmission from the multi-output sensor, determining a state of each of the sensitivity levels, determining if at least one selection criterion is set, selecting one of the plurality of sensitivity levels based upon the determination, and responding to the selected sensitivity level.

Also disclosed is a control panel adapted to receive a transmission from a multi-output sensor. The transmission includes a state of a plurality of sensitivity levels for the multi-output sensor indicating multiple outputs. The control panel is programmed with at least one selection criterion for selecting one of the plurality of sensitivity levels from the transmission. The control panel comprises a processor for executing computer-readable program code provided on computer-readable storage medium, the computer-readable program code having instructions which causes the processor to execute a method. The method comprises determining a state of each of the sensitivity levels included in the transmission, determining if at least one selection criterion is set for selecting one of the sensitivity levels, selecting one of the plurality of sensitivity levels based upon the determination and responding to the selected sensitivity level.

Also disclosed is a control panel adapted to receive a transmission from a plurality of multi-output sensors. Each transmission includes a state of a plurality of sensitivity levels for each multi-output sensor indicating multiple outputs of the sensor. The control panel is programmed with at least one selection criterion for selecting one of the plurality of sensitivity levels from the transmission from each multi-output sensor. The control panel comprises a processor for executing computer-readable program code provided on computer-readable storage medium, the computer-readable program code having instructions which causes the processor to execute a method. The method comprises determining a source of the transmission, determining a state of each of the sensitivity levels, determining if at least one selection criterion is set based upon the determined source, selecting one of the plurality of sensitivity levels based upon the determination, and responding to the selected sensitivity level. The source is one of the plurality of sensors.

BRIEF DESCRIPTION OF THE DRAWINGS

These and other features, benefits and advantages of the present invention will become apparent by reference to the following figures, with like reference numbers referring to like structures across the views, wherein.

DETAILED DESCRIPTION OF THE INVENTION

Figure 1:
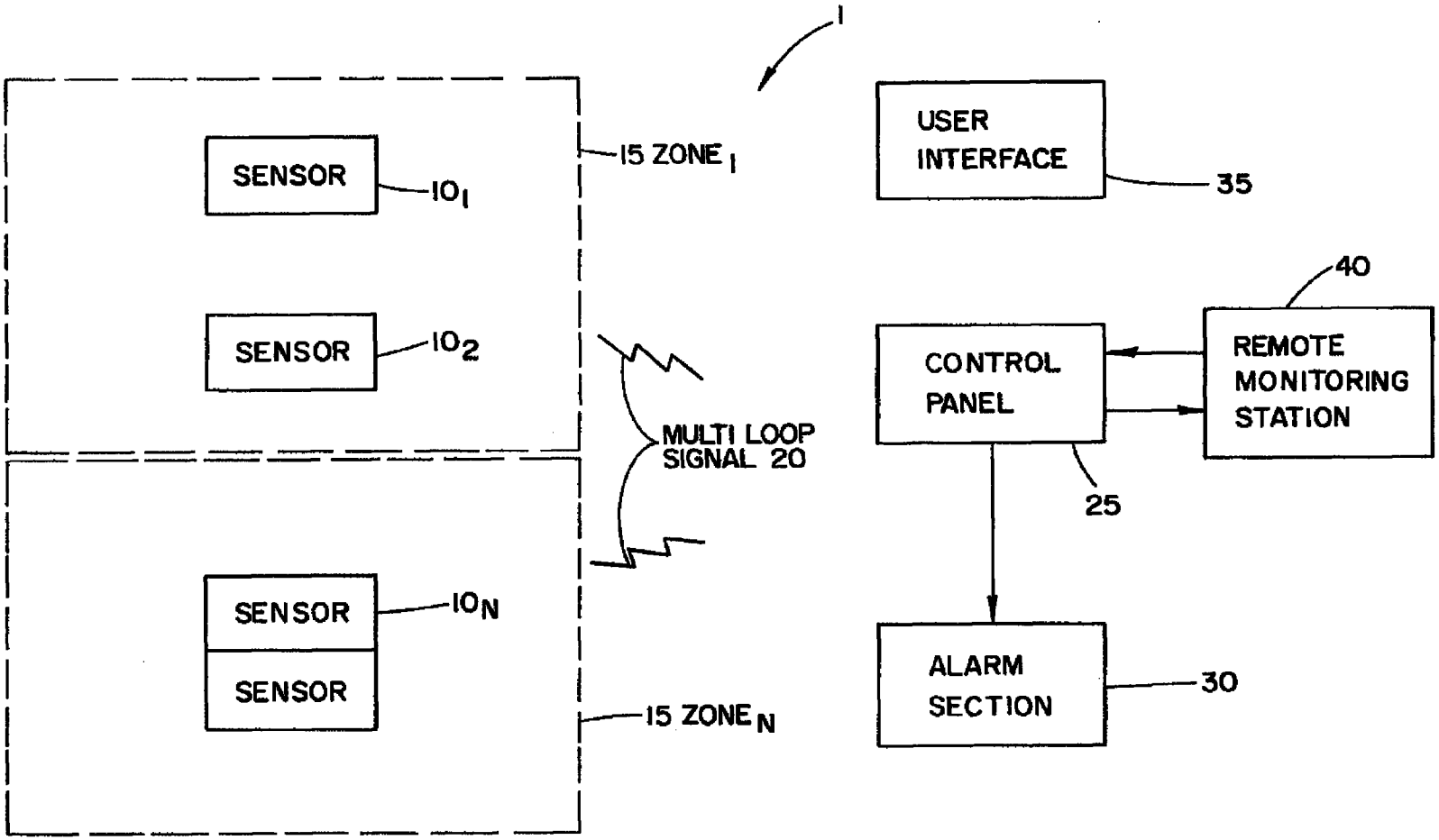
FIG. 1 illustrates a block diagram of the security system with multi-output sensors in accordance with an embodiment of the invention.

FIG. 1 illustrates a diagram of a sample security system 1. The security system 1 includes a control panel 25 that communicates with a number of sensors 10 via a wired or wireless path. The sensors 10 are deployed throughout the protected premises. The sensors 10 are separated into specific zones 15. There are many types of sensors 10 that can be used with the invention, including, but not limited to asset, glass break, shock, impact, motion, temperature and dual technology sensors. More than one sensor 10 can be deployed in a specific zone 15. The control panel 25 is configured to activate an alarm section 30 based upon signals received from the sensors 10. For example, the control panel 25 may receive signals from motion sensor 10 that detects when a person enters a specific zone.

The sensors 10 are configured to have a plurality of sensitivity levels. The sensors 10 can transmit a multi-loop signal 20 to the control panel 25. The specific loops transmitted are indicative of whether an event is detected based upon a corresponding sensitivity level. All of the loops are transmitted in one signal. For example, a passive infrared sensor might have sensitivity levels corresponding to the number of steps an intruder has taken within a given zone of protected area. A temperature sensor might have sensitivity levels corresponding to different temperatures, such as cool, warm, and hot.

The security system 1 further includes a user interface 35. As illustrated, the user interface 35 is separate from the control panel 25; however, the two can be integrated.

The user interface 35 is commonly provided in a housing and affixed to a wall or placed on a table. The control panel 25 may be installed, e.g., in a closet or basement.

Signals received from the user interface 35, such as a keypad and display, a combined display and touch screen, and/or a voice interface may arm and disarm the security system 1. The user interface 35 is the primary interface between the user and the security system 1 allowing a user to change the status of the security system 1 or allow an installer to configure the security system 1. The user interface 35 may include components that are similar to the control panel 25, including a control, memory, and power source.

The control panel 25 is adapted to notify local emergency services and/or a remote monitoring station 40 of an alarm condition via a telephone dialer. Furthermore, a telephone network interface (not shown), such as a modem, allows the control panel 25 to send and receive information via a communication link.

Figure 2:
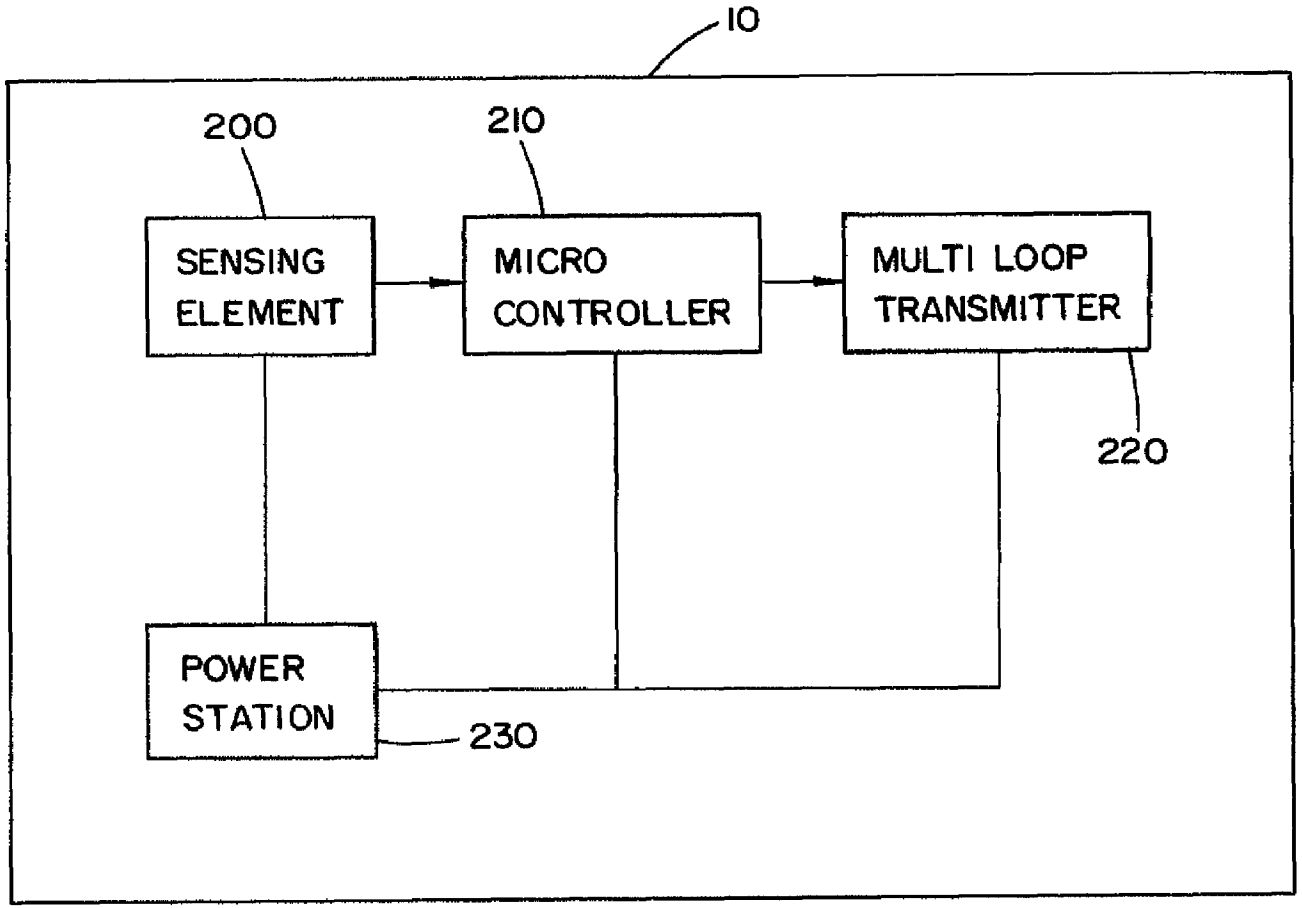
FIG. 2 illustrates an exemplary multi-output sensor of the invention.

FIG. 2 illustrates a block diagram of an exemplary sensor 10 that can be used in accordance with the invention. The sensor 10 includes a sensing element 200, a microcontroller 210, a multi-loop transmitter 220 and a power source 230. The sensing element is adapted to sense or detect an event within the protected area, e.g., motion, glass break, temperature. The microcontroller 210 includes a storage section having a plurality of sensitivity thresholds corresponding to each sensitivity level. The sensor 10 has a plurality of discrete outputs, i.e., loops, each corresponding to the one of the plurality of sensitivity levels. The microcontroller 210 determines the state for each output and aggregates the state information for each output for transmission to the control panel 25. For example, if the sensor 10 is a PIR having three different sensitivity levels, low, medium and high, some movement might cause a medium and high output to be triggered. The microcontroller will aggregate the state of all three outputs in one signal, i.e. 011. In an embodiment, the state information is represented by a one bit of the signal. A "0" indicates that the threshold is not met and a "1" indicates an event is detected based upon the sensitivity threshold for the level.

The multi-loop transmitter 220 is capable of transmitting multiple loops to the control panel 25.

According to the invention, the control panel 25 is programmed to respond to one of the plurality of discrete outputs based upon certain selection criterion. For example, if the signal includes a 011 for the states of three outputs, e.g. three different sensitivity levels, the control panel only responds to one output. The invention allows the control panel 25 to determine a response to a particular output or sensitivity level based upon local conditions as opposed to having one sensitivity pre-assigned for use at all times.

Figure 3:
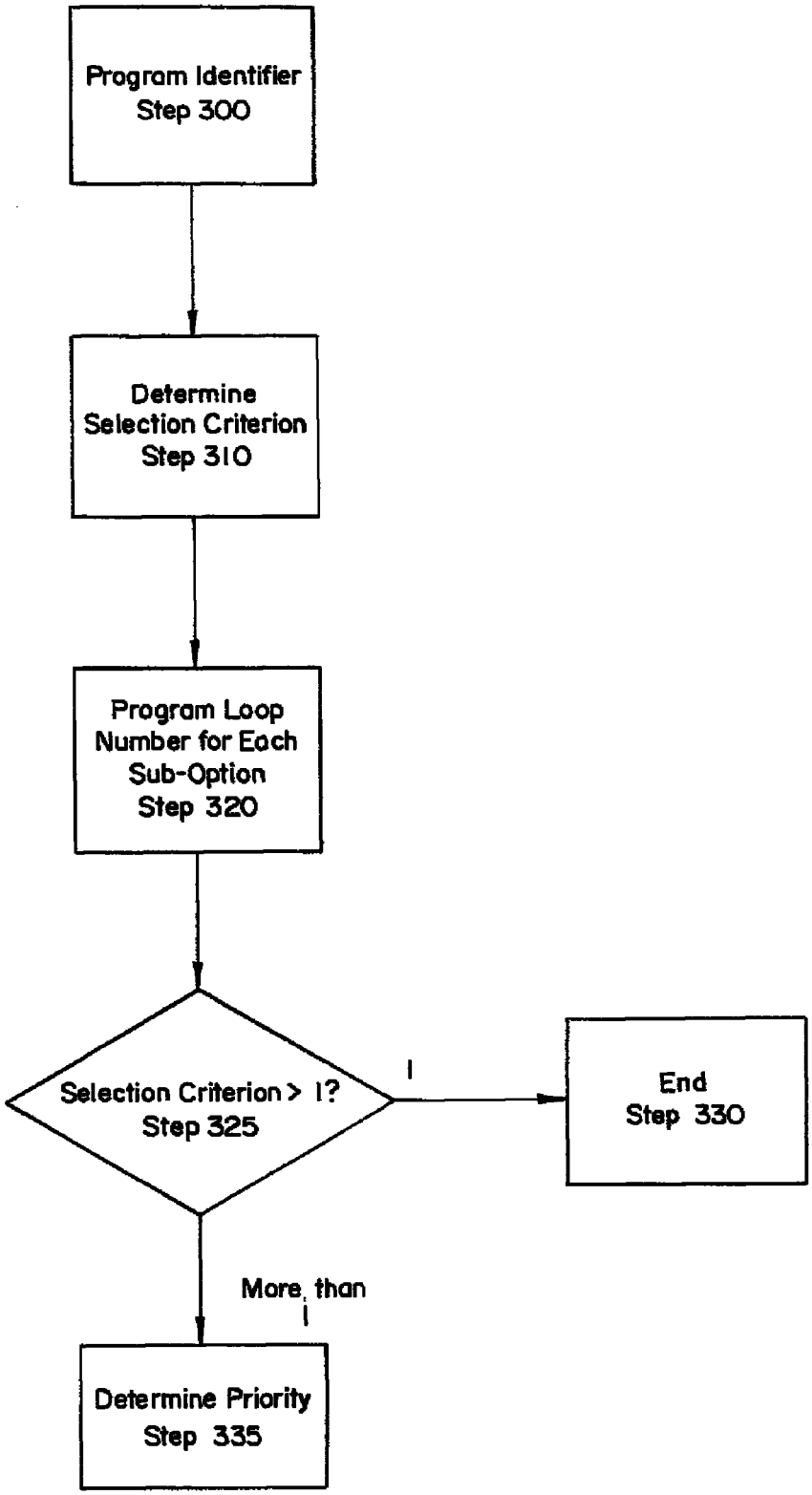
FIG. 3 illustrates a flow chart of the method of configuring the security system to dynamically change the sensitivity of a multi-output sensor according to an embodiment of the invention.

FIG. 3 illustrates a flow chart for the method of configuring the control panel 25 to adjust the sensitivity according to the invention. The control panel 25 can be programmed using the user interface 35. In another embodiment, the control panel 25 can be remotely configured using a configuration computer, i.e., using a program marketed by Honeywell, Ademco Compass Downloader. This software permits a user to remotely program and control a security system.

The user will create a table or database that is used by the control panel 25 to determine a response. The table includes the sensor identifier, each selection criterion, sub-options for the selection criterion, the loop number for each sub-option and a priority if more than one selection criterion is used. The table or database will contain multiple sensor records, where each sensor record is indexed by the sensor identifier.

At step 300, the unique identifier for the sensor 10 is programmed. Each sensor 10 is identified by an unique identifier. Each multi-loop signal 20 transmitted by a sensor 10 contains the unique identifier.

At step 310, at least one selection criterion is programmed. The selection criterion can include, but is not limited to, the status of the security system 1, such as armed or disarmed, the state of the system, such as an alarm state, a time schedule, the temperature of the premises, the state of other sensors in the same zone as the sensor, and the state of a HVAC. In an embodiment, the programming includes selecting a selection criterion from a list of available selection criterion. In an embodiment, some of the selection criterion will have preset sub-options for the selection. For example, if the selected criterion is a status of the security system, the preset sub-options can be disarm, arm-away and arm-stay. Alternatively, some of the selection criterion will allow a user to customize the sub-options. For example, if the selection criterion is a time schedule, the user can create a customized schedule for each sub-option.

At step 320, one loop number of the available outputs (loop numbers) for the sensor 10 is assigned to the each of the sub-options for the selection criterion. For example, if the selected criterion is status of the security system, loop 1 can be programmed for disarm, loop 2 can be programmed of arm-stay, and loop 3 can be programmed for arm-away. In an embodiment, not all loop numbers must be assigned to a sub-option.

Steps 310 and 320 are repeated for each selection criterion.

At step 325, the control panel 25 determines if more than one selection criterion was entered, at steps 310 and 320. If only one selection criterion is entered, the configuration process ends, at step 330.

On the other hand, if more than one selection criterion has been entered, the control panel 25 prompts the user or installer for a priority for the criterion. At step 335, a priority to the selection criterion is entered.

A priority is selected to resolve any conflict between more than one selection criteria. For example, if the selection criterion is both a time of day and the status of the security system 1, a conflict can arise if one selection criterion dictates that a first sensitivity level should be selected and the other selection criterion dictates that a second sensitivity level should be selected.

The installer can customize the priority. In another embodiment, a default priority can be used. For example, the default priority can be (i) safety related selection criterion having first priority at all times; (ii) security system status having second priority; (iii) a scheduled time having third priority; (iv) environmental selection criterion having fourth priority; and (v) other miscellaneous selection criterion having fifth priority.

A safety related selection criterion includes the state of the security system 1 and state of other sensors, in the zone or out of the zone. In other words, if any sensor detects an alarm condition, or a fire is detected, the control panel 25 will select the maximum sensitivity level without regard to any other selection criterion in accordance with the programmed selection criterion.

An environment selection criterion can include, but is not limited to, a temperature of the protected premises, the internal weather, sound level within the protected premises, and the state of the HVAC.

Figure 4:
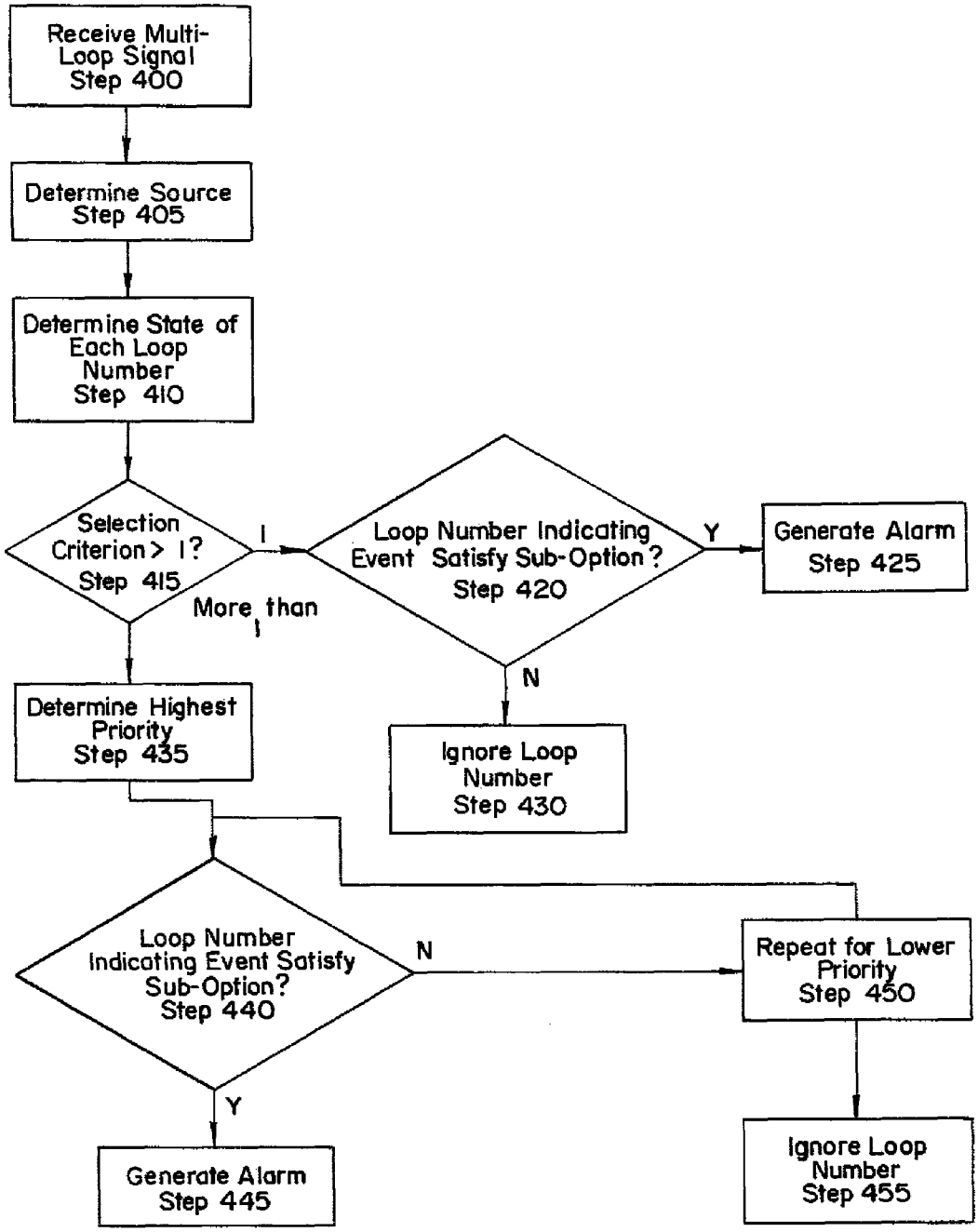
FIG. 4 illustrates a flow chart of the method for dynamically changing the sensitivity of a multi-output sensor in accordance with an embodiment of the invention.

FIG. 4 illustrates a method of responding to the multi-loop signal 20 to adjust the sensitivity level of the sensor 10.

At step 400, the control panel 25 receives a multi-loop signal 20 from the sensor 10.

The multi-loop signal 20 includes the unique identifier for the sensor and a state of each loop, i.e., each sensitivity level. The multi-loop signal 20 is periodically, transmitted to the control panel 25.

At step 405, the control panel 25 determines the source of the multi-loop signal 20. The control panel 25 extracts the unique identifier from the multi-loop signal 20 and compares the unique identifier with identifiers stored in a storage section. The control panel 25 retrieves the selection information corresponding to the unique identifier, i.e., a sensor record. At step 410, the control panel 25 determines the state of each loop using the data included in the multi-loop signal 20, i.e., "0" or "1". As stated above, a "1" indicates that an event has been detected using a detection threshold for the specific sensitivity, e.g., low, medium, high.

The control panel 25 then determines if there are more than one selection criterion programmed for the sensor 10, at step 415. If only one selection criterion is set for the sensor 10, the control panel 25 determines the current information that corresponds to the sub-options for the selection criterion, at step 420. This determination will depend on the selection criterion. If the selection criterion is a temperature, the current temperature is determined. If the selection criterion is a sound, the sound level within the premises is determined. If the selection criterion is a status of the security system 1, the current status is determined, i.e., disarm, arm-stay and arm-away. If the selection criterion is a state of the security system 1, the current state is determined, i.e., alarm. If the selection criterion is a time schedule, the time of reception is determined.

This determination is used to select the sub-option that matches the current state information.

The control panel 25 matches each loop number having detected an event, e.g. "1", with the loop number that corresponds with the selected sub-option. If there is a match, i.e., satisfied for the received loop number, an alarm is generated, at step 425. If there is no match, the detection of an event is ignored, at step 430.

For example, if the selection criterion is a time schedule, and the sub-options are preset as loop 1=9 AM-5 PM, loop 2=5:01 PM-12 AM and loop 3=12:01 AM-8:59 AM, the control panel determines the time of receipt of the multi-loop signal 20. If the time is within the time schedule for one of the loop numbers that have detected an event, e.g., "1", the control panel 25 responds to the signal, i.e., generates an alarm. If the time is not within the time schedule for any of the loop numbers that have detected an event, e.g., "1", the control panel ignores the loop.

The control panel 25 only responds to one loop, i.e., the loop corresponding to the desired sensitivity.

If there are more than one selection criterion programmed for the sensor 10, the control panel 25 determines the priority for the selection criteria, at step 435. The selection criterion with the highest priority is examined first, at step 440. The examination is the same as described above and will not be described again. As noted above, if a loop number having detected an event, e.g. "1", matches the loop number that corresponds with the selected sub-option, an alarm is generated, at step 445. If there is no match, the process is repeated for each of the selection criterion with a lower priority, step 450. The highest selection criterion has a sub-option satisfied for the loop number that detected an event causing the alarm to be generated. If no sub-option is satisfied for any selection criterion, all detected events are ignored at step 455.

Figure 5:
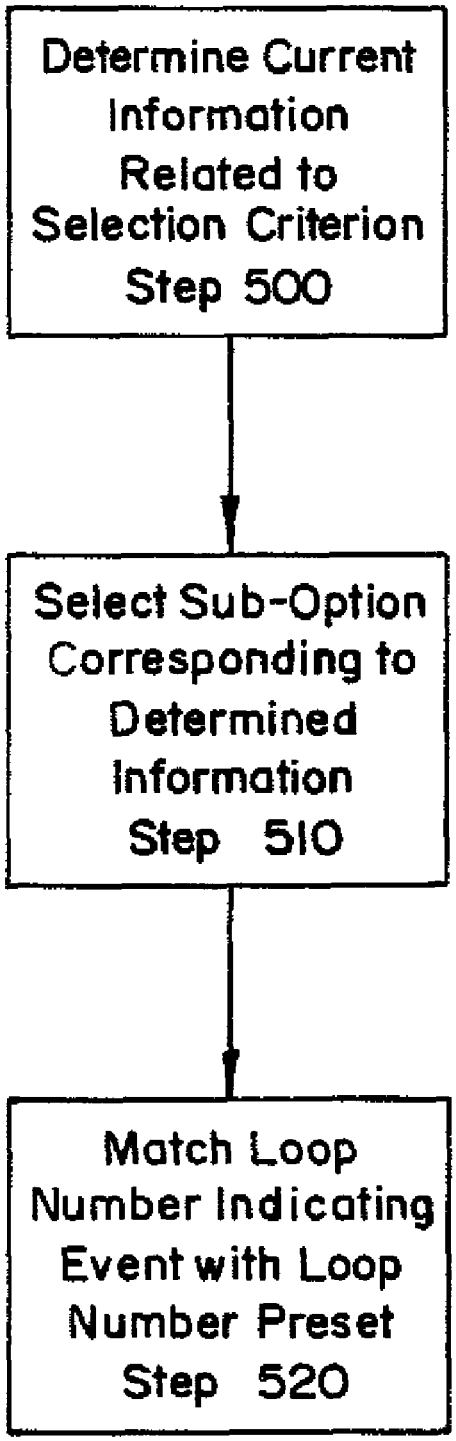
FIG. 5 illustrates a flow chart of the method for determining if a sub-option for a selection criterion is met.

FIG. 5 illustrates the method of determining whether a sub-option is satisfied for a loop number or sensitivity level that detected an event. At step 500, information is updated or determined for the current period for the selection criterion, e.g., time, state, status, sound or temperature level. At step 510, the sub-option corresponding to the determined information is selected, e.g., if the security system 1 is determined to be armed-away, the sub-option "arm-away" is selected.

The selected sub-option was assigned a specific loop number during the configuration process. At step 520, each loop number that detected an event, e.g., "1", is compared with the pre-assigned loop number. If a match is found, an alarm is generated.

The invention has been described herein with reference to a particular exemplary embodiment. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A method for dynamically changing a control panel response to a transmission from a plurality of multi-output sensors, where the transmission includes a state of each of a plurality of different sensitivity levels for each of the plurality of multi-output sensors where the different sensitivity levels together provide multiple outputs for each of the multi-output sensors, the control panel has a plurality of operational states and is programmed with a plurality of selection criterion for selecting one of the plurality of sensitivity levels from the transmission from each multi-output sensor where each operational state of the plurality of operational states is associated with at least one selection criteria of the plurality of selection criteria, the method comprising the steps of:

receiving a selection of an operational state of the control panel of the plurality of operational states through a user interface;

receiving a multi-loop transmission from one of said plurality of multi-output sensors;

determining a source of the transmission;

determining a state of each of the different sensitivity levels;

matching at least one of the plurality of selection criterion with said determined source and the selected operational state of the control panel;

selecting one of the plurality of different sensitivity levels based upon said matched at least one selection criteria; and providing an output based upon a relative value of said selected sensitivity level.

2. The method for dynamically changing a control panel response according to claim 1, wherein said multi-output sensor includes a multi-loop transmitter, each loop corresponding to one output of said multi-output sensor.

3. The method for dynamically changing a control panel response according to claim 2, wherein each loop is assigned a loop number, and said loop number is associated with one output, at least two different loop numbers are assigned to sensitivity levels.

4. The method for dynamically changing a control panel response according to claim 3, wherein changing the loop number in which a control panel responds changes said sensitivity of said multi-output sensor.

5. The method for dynamically changing a control panel response according to claim 1, wherein said selection criterion is a specific time.

6. The method for dynamically changing a control panel response according to claim 5, wherein said selecting step includes the sub-steps of:

detecting a time of receipt of said at least one output; and determining if the time of receipt is within a specific time for a sub-option for the selection criterion; and selecting the sub-option that includes the time of reception within its specific time.

7. The method for dynamically changing a control panel response according to claim 1, wherein said selection criterion is a status of the security system.

8. The method for dynamically changing a control panel response according to claim 7, wherein said determining if said selection criterion is occurring includes the sub-steps of:

detecting a current status of said security system; and selecting a sub-option that corresponds with the current status.

9. The method for dynamically changing a control panel response according to claim 1, wherein a sub-option for the status is arm-stay.

10. The method for dynamically changing a control panel response according to claim 1, wherein a sub-option for the status is arm-away.

11. The method for dynamically changing a control panel response according to claim 1, wherein said selection criterion is a state of alarm of the security system.

12. The method for dynamically changing a control panel response according to claim 11, wherein a sub-option for the state is active alarm and a control panel responds to the state of a maximum sensitivity included in the transmission if said security system is in an active alarm.

13. The method for dynamically changing a control panel response according to claim 1, wherein said selection criterion is a state of the other sensors of the security system.

14. The method for dynamically changing a control panel response according to claim 1, wherein said selection criterion is a zone where said multi-output sensor is located.

15. The method for dynamically changing a control panel response according to claim 1, wherein said selection criterion is an environmental condition.

16. The method for dynamically changing a control panel response according to claim 1, wherein said environmental condition is a temperature of a protected premises.

17. The method for dynamically changing a control panel response according to claim 1, wherein said selection criterion is a state of an HVAC.

18. The method for dynamically changing a control panel response according to claim 1, wherein said selection criterion is programmed during installation.

19. The method for dynamically changing a control panel response according to claim 1, wherein said selection criterion is programmed remotely.

20. The method for dynamically changing a control panel response according to claim 1, further including the steps of:

determining if more than one selection criterion is associated with the source; and selecting one of the plurality of sensitivity levels for response based on the selection criterion with the highest priority.

21. The method for dynamically changing a control panel response according to claim 1, wherein the response depends on the state of the selected sensitivity level.

22. A method for configuring a control panel of a security system to dynamically change a response comprising the steps of:

providing a plurality of sensors within the security system;

assigning a loop number to each loop of a multi-loop transmission from a multi-output sensor of the plurality of sensors, with a loop number associated with each of at least two different sensitivity levels;

programming an unique identifier associated with said one multi-output sensor into said control panel;

selecting one of a plurality of operational states of the control panel through a user interface;

determining at least one selection criterion based on the selected operational state, the unique number associated with the multi-output sensor and a state of activation of at least one other of the plurality of sensors;

assigning each loop number to a corresponding sub-option for said at least one selection criterion; and said control panel providing an output in response to one of said loops identified by an assigned loop number detecting an event during a time associated with the corresponding sub-option, the operational state of the control panel and the state of the at least one other of the plurality of sensors.

23. A method for configuring a control panel of a security system to dynamically change a response according to claim 22 further comprising:

determining each sub-option for each of said at least one selection criterion.

24. A method for configuring a control panel of a security system to dynamically change a response according to claim 22, wherein if more than one selection criterion is determined, the method further comprising:

setting a priority for said more than one selection criterion.

25. A method for configuring a control panel of a security system to dynamically change a response according to claim 24, wherein said setting step includes selecting a default priority.

26. A control panel adapted to receive a multi-loop transmission from a multi-output sensor, where the transmission includes a state of each of a plurality of different sensitivity levels for the multi-output sensor where the different sensitivity levels together provide multiple outputs, the control panel has a plurality of operational states and is programmed with a plurality of selection criterion for selecting one of the plurality of sensitivity levels from the transmission where each operational state of the plurality of operational states is associated with at least one of the plurality of selection criteria, the control panel comprising:

a processor for executing computer-readable program code provided on a computer-readable storage medium, the computer-readable program code having instructions which cause said processor to execute the following steps:

receiving a selection of one of the plurality of operational states through a user interface;

determining a state of each of the sensitivity levels included in the multi-loop transmission;

matching at least one selection criterion of the plurality of selection criterion with the associated operational state;

selecting one of the plurality of sensitivity levels based upon said determination; and providing an output in response to an event detected by said selected sensitivity level.

27. A method for dynamically changing a control panel response to a multi-loop transmission from a multi-output sensor, where the transmission includes a state of each of a plurality of different sensitivity levels for the multi-output sensor the different sensitivity levels together providing multiple outputs, the control panel includes a plurality of operational states and is programmed with a plurality of selection criterion for selecting one of the plurality of sensitivity levels from the transmission where each of the plurality of operational states is associated with at least one of the plurality of selection criteria, the method comprising the steps:

receiving a selection of an operational state of the plurality of operational states through a user interface;

receiving a multi-loop transmission from the multi-output sensor;

determining a state of each of the sensitivity levels;

determining if at least one selection criterion of the plurality of selection criterion is satisfied based upon the selected operational state;

selecting one of the plurality of sensitivity levels based upon said determination of the at least one selection criteria; and providing an output in response to an event detected by said selected sensitivity level.

28. A control panel adapted to receive a multi-loop transmission from each of a plurality of multi-output sensors, where the transmission includes a state of each of a plurality of different sensitivity levels for the plurality of multi-output sensors the sensitivity levels together providing multiple outputs, the control panel having a plurality of operational states and is programmed with a plurality of selection criterion for selecting one of the plurality of sensitivity levels from the transmission for each of the plurality of multi-output sensors where each of the plurality of operational states is associated with at least one of the selection criteria, the control panel comprising:

a processor for executing computer-readable program code provided on a computer-readable storage medium, the computer-readable program code having instructions which causes said processor to execute the following steps:

receiving a selection of one of the plurality of operational states through a user interface;

determining a source of the multi-loop transmission, the source being one of the plurality of sensors;

determining a state of each of the sensitivity levels;

determining that at least one selection criterion of the plurality of selection criterion is satisfied based upon said determined source and based upon the selected operational state;

selecting one of the plurality of sensitivity levels based upon said determination; and providing an output in response to an event detected by said selected sensitivity level.

* * * * *